US006131303A

United States Patent [19]

Roper

[11] Patent Number: 6,131,303

[45] Date of Patent: Oct. 17, 2000

[54] BODY DRYER

[76] Inventor: Mike Roper, 23 Pebble Drive, Didcot, Oxford 0X11 9RE, United Kingdom

[21] Appl. No.: 09/353,957

[22] Filed: Jul. 15, 1999

[51] Int. Cl.[7] ..... F26B 19/00

[52] U.S. Cl. ..... 34/90; 34/233; 34/239

[58] Field of Search ..... 34/90, 97, 103, 34/107, 202, 233, 239; D28/54.1; 392/380, 381, 384

[56] References Cited

U.S. PATENT DOCUMENTS

| | | | |
|---|---|---|---|
| 3,878,621 | 4/1975 | Duerre | 34/90 |
| 4,961,272 | 10/1990 | Lee | 34/90 |
| 5,007,182 | 4/1991 | Fishman et al. | 34/90 |
| 5,099,587 | 3/1992 | Jarosch | 34/233 X |
| 5,269,071 | 12/1993 | Hamabe et al. | 34/90 X |
| 5,386,644 | 2/1995 | Lawall et al. | 34/90 |
| 5,651,189 | 7/1997 | Coykendall et al. | 34/90 |
| 5,752,326 | 5/1998 | Trim | 34/233 X |
| 5,873,179 | 2/1999 | Gregory et al. | 34/90 |
| 5,930,912 | 8/1999 | Carder | 34/90 |
| 5,953,830 | 9/1999 | Jannach | 34/239 X |

*Primary Examiner*—Stephen Gravini

[57] ABSTRACT

A body dryer for drying the body with blown warm air. The body dryer includes a blower housing with inlet and outlet openings. The blower housing has a heater and a fan therein for drawing air into the blower via the inlet opening and out of the blower housing via the outlet opening. An elongate outer tube has an elongate inner tube disposed therein. An upper end of the inner tube is in communication with the outlet opening of the blower housing. The outer tube has a plurality of spaced apart vent holes arranged in a row extending between the upper and lower ends of the outer tube. The inner tube has an elongate full vent slot extending between the upper and lower ends of the inner tube and a plurality of spaced apart partial vent slots arranged in a pair of rows extending between the upper and lower ends of the inner tube adjacent the full vent slot.

9 Claims, 3 Drawing Sheets

FIG. 3
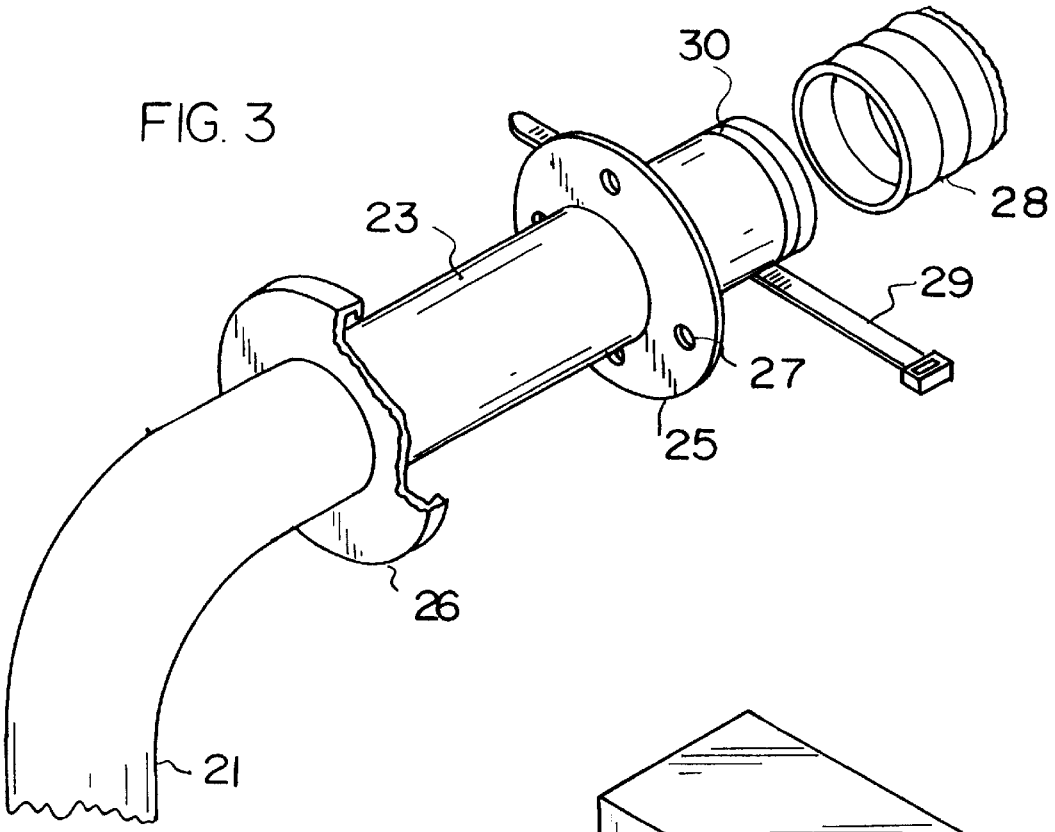
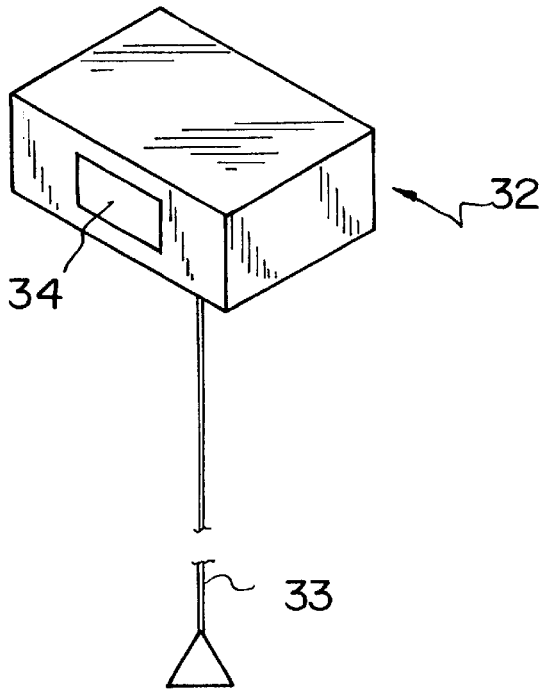
FIG. 4

BODY DRYER

BACKGROUND OF THE INVENTION

1. Field of the Invention

The present invention relates to body dryers and more particularly pertains to a new body dryer for drying the body with blown warm air.

2. Description of the Prior Art

The use of body dryers is known in the prior art. More specifically, body dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 311,070; U.S. Pat. No. 5,269,071; U.S. Pat. No. 2,977,455; U.S. Pat. No. 5,377,424; U.S. Pat. No. 4,961,272; and U.S. Pat. No. 3,878,621.

While these devices fulfill their respective, particular objectives and requirements, the aforementioned patents do not disclose a new body dryer. The inventive device includes a blower housing with inlet and outlet openings. The blower housing has a heater and a fan therein for drawing air into the blower via the inlet opening and out of the blower housing via the outlet opening. An elongate outer tube has an elongate inner tube disposed therein. An upper end of the inner tube is in communication with the outlet opening of the blower housing. The outer tube has a plurality of spaced apart vent holes arranged in a row extending between the upper and lower ends of the outer tube. The inner tube has an elongate full vent slot extending between the upper and lower ends of the inner tube and a plurality of spaced apart partial vent slots arranged in a pair of rows extending between the upper and lower ends of the inner tube adjacent the full vent slot.

In these respects, the body dryer according to the present invention substantially departs from the conventional concepts and designs of the prior art, and in so doing provides an apparatus primarily developed for the purpose of drying the body with blown warm air.

SUMMARY OF THE INVENTION

In view of the foregoing disadvantages inherent in the known types of body dryers now present in the prior art, the present invention provides a new body dryer construction wherein the same can be utilized for drying the body with blown warm air.

The general purpose of the present invention, which will be described subsequently in greater detail, is to provide a new body dryer apparatus and method which has many of the advantages of the body dryers mentioned heretofore and many novel features that result in a new body dryer which is not anticipated, rendered obvious, suggested, or even implied by any of the prior art body dryers, either alone or in any combination thereof.

To attain this, the present invention generally comprises a blower housing with inlet and outlet openings. The blower housing has a heater and a fan therein for drawing air into the blower via the inlet opening and out of the blower housing via the outlet opening. An elongate outer tube has an elongate inner tube disposed therein. An upper end of the inner tube is in communication with the outlet opening of the blower housing. The outer tube has a plurality of spaced apart vent holes arranged in a row extending between the upper and lower ends of the outer tube. The inner tube has an elongate full vent slot extending between the upper and lower ends of the inner tube and a plurality of spaced apart partial vent slots arranged in a pair of rows extending between the upper and lower ends of the inner tube adjacent the full vent slot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new body dryer apparatus and method which has many of the advantages of the body dryers mentioned heretofore and many novel features that result in a new body dryer which is not anticipated, rendered obvious, suggested, or even implied by any of the prior art body dryers, either alone or in any combination thereof.

It is another object of the present invention to provide a new body dryer which may be easily and efficiently manufactured and marketed.

It is a further object of the present invention to provide a new body dryer which is of a durable and reliable construction.

An even further object of the present invention is to provide a new body dryer which is susceptible of a low cost of manufacture with regard to both materials and labor, and which accordingly is then susceptible of low prices of sale to the consuming public, thereby making such body dryer economically available to the buying public.

Still yet another object of the present invention is to provide a new body dryer which provides in the apparatuses and methods of the prior art some of the advantages thereof, while simultaneously overcoming some of the disadvantages normally associated therewith.

Still another object of the present invention is to provide a new body dryer for drying the body with blown warm air.

Yet another object of the present invention is to provide a new body dryer which includes a blower housing with inlet and outlet openings. The blower housing has a heater and a fan therein for drawing air into the blower via the inlet opening and out of the blower housing via the outlet opening. An elongate outer tube has an elongate inner tube disposed therein. An upper end of the inner tube is in communication with the outlet opening of the blower housing. The outer tube has a plurality of spaced apart vent holes arranged in a row extending between the upper and lower ends of the outer tube. The inner tube has an elongate full vent slot extending between the upper and lower ends of the inner tube and a plurality of spaced apart partial vent slots arranged in a pair of rows extending between the upper and lower ends of the inner tube adjacent the full vent slot.

Still yet another object of the present invention is to provide a new body dryer that rapidly dries a user's wet body without having to use a towel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic partial perspective view of the upper extent region of the outer tube.

FIG. 4 is a schematic perspective view of the switch housing.

DESCRIPTION OF THE PREFERRED EMBODIMENT

With reference now to the drawings, and in particular to FIGS. 1 through 7 thereof, a new body dryer embodying the principles and concepts of the present invention will be described.

As best illustrated in FIGS. 1 through 7, the body dryer generally comprises a blower housing with inlet and outlet openings. The blower housing has a heater and a fan therein for drawing air into the blower via the inlet opening and out of the blower housing via the outlet opening. An elongate outer tube has an elongate inner tube disposed therein. An upper end of the inner tube is in communication with the outlet opening of the blower housing. The outer tube has a plurality of spaced apart vent holes arranged in a row extending between the upper and lower ends of the outer tube. The inner tube has an elongate full vent slot extending between the upper and lower ends of the inner tube and a plurality of spaced apart partial vent slots arranged in a pair of rows extending between the upper and lower ends of the inner tube adjacent the full vent slot.

Figure 7:
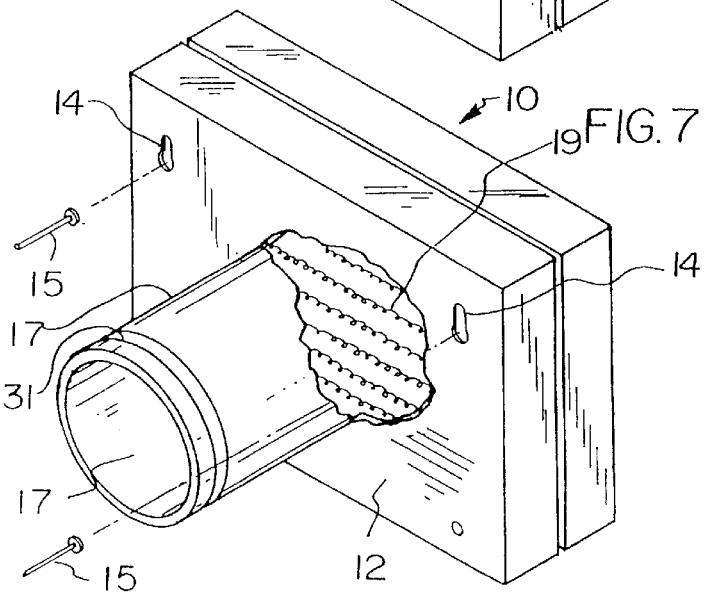
FIG. 7 is a schematic back breakaway perspective view of the blower housing.

In closer detail, the body dryer comprises a blower housing 10 with front and back faces 11,12 mounted to a wall surface 13. As illustrated in FIG. 7, the blower housing preferably has a pair of mounting holes 14 in the back face of the blower housing into which a pair of mounting fasteners 15 outwardly extending from the wall surface may be inserted to mount the blower housing to the wall surface.

The front face of the blower housing has an inlet opening 16 into the blower housing. The back face of the blower housing has an outlet tube 17 extending therefrom into the wall surface. The outlet tube has an outlet opening 18 into the blower housing. The blower housing has a heater 19 therein such as a plurality of heating coils for heating air in the blower housing. The blower housing also has a fan 20 therein for drawing air into the blower via the inlet opening, past the heater, and out of the blower housing via the outlet opening such that air passing through the blower housing is heated by the heater.

An elongate outer tube 21 is provided with an elongate inner tube 22 disposed in the outer tube to permit rotation of the inner tube. The outer and inner tubes each have opposite open upper and closed lower ends, and a longitudinal axis extending between the upper and lower ends of the respective tube. The upper end of the inner tube is positioned adjacent the upper end of the outer tube while the lower end of the inner tube is positioned adjacent the lower end of the lower tube. The longitudinal axes of the outer and inner tubes are generally coaxial with one another with the inner tube rotatable in the outer tube about an axis of rotation coaxial with the longitudinal axes of the outer and inner tubes.

Figure 1:
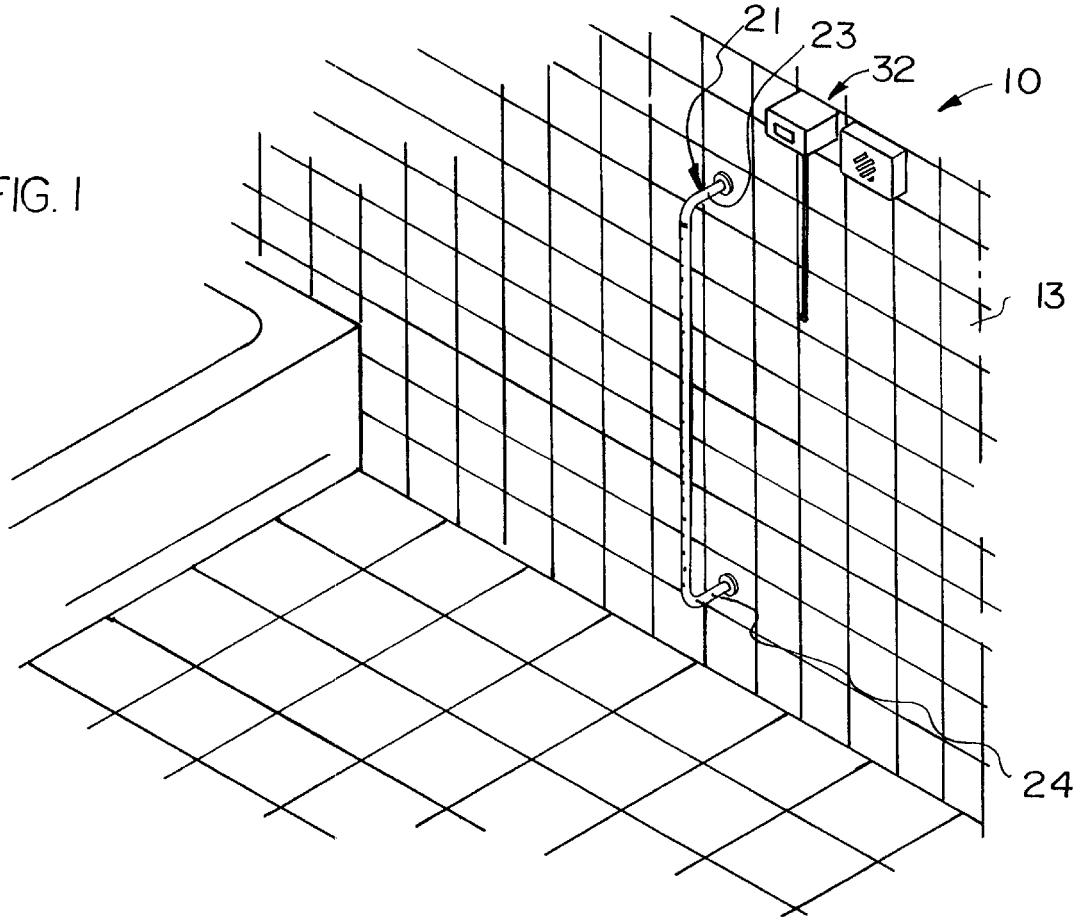
FIG. 1 is a schematic perspective view of a new body dryer according to the present invention.

As illustrated in FIG. 1, the upper and lower ends of the outer tube are mounted to the wall surface so that the longitudinal axis of the outer and inner tubes are extended generally vertically and generally parallel to the wall surface. Preferably, the upper and lower ends of the outer tube each have an extent 23,24 extending therefrom generally perpendicular to the longitudinal axis of the outer tube. The extents are mounted to the wall surface such that the outer tube is spaced apart from the wall surface. Ideally, the extents each have an annular mounting flange 25 and an annular flange cover 26 disposed therearound. The mounting flanges of the extents each have a plurality of mounting holes 27 therethrough with each mounting hole having a fastener extended therethrough and into the wall surface to mount the mounting flanges to the wall surface. The flange covers each cover the associated mounting flange on the wall surface to provide a finished look and to protect the mounting fasteners from moisture.

The extent 23 of the upper end of the outer tube is inserted into the wall surface and the upper end of the inner tube is in fluid communication with the outlet opening of the blower housing via the extent of the outer tube to permit air to be blown into the inner tube from the blower housing. Preferably, a flexible hose 28 (preferably a corrugated hose) extending through the wall surface fluidly connects the upper end of the inner tube to the outlet opening of the blower housing. The hose has a pair of opposite open ends. The outlet tube of the blower housing is inserted into one of the ends of the hose to fluidly connect the outlet opening to the hose and the extent of the upper end of the outer tube is inserted into the other of the ends of the hose to fluidly connect the outlet opening to the hose. Ideally, as illustrated in FIG. 3, each of the ends of the hose is secured to the extent and outlet tube by elongate ties 29 extended around each end of the hose and the associated extent or outlet tube. In this ideal embodiment, the extent of the upper end of the outer tube and the outlet tube each preferably have an annular groove 30,31 therearound for receiving the associated tie and a portion of the hose therein.

Preferably, a switch is electrically connected to the fan and the heater for permitting selective activation of the fan and heater.

The switch has a housing 32 mounted to the wall surface adjacent the blower housing. The switch also has a pull cord actuator 33 downwardly depending from the housing of the switch. In use, pulling a first tug on the pull cord actuator activates the heater and blower, while pulling a subsequent second tug deactivates the heater and blower. The switch also preferably has an indicator light source 34 on the housing of the switch to provide a visual indicator when the switch is activating and deactivating the heater and blower. The indicator light is electrically connected to the switch so that the light source is illuminated when the heater and blower are activated by the switch.

Figure 5:
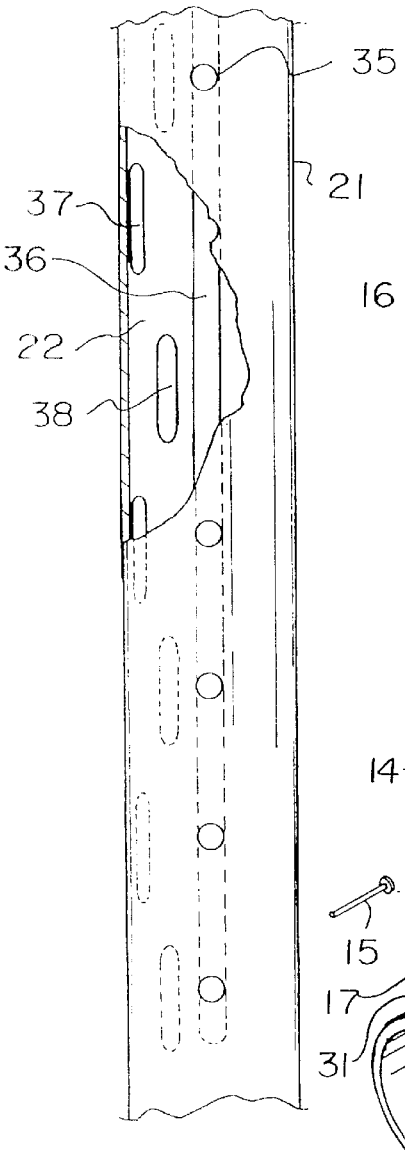
FIG. 5 is a schematic partial breakaway side view of a lower end region of the outer and inner tubes of the present invention.
Figure 6:
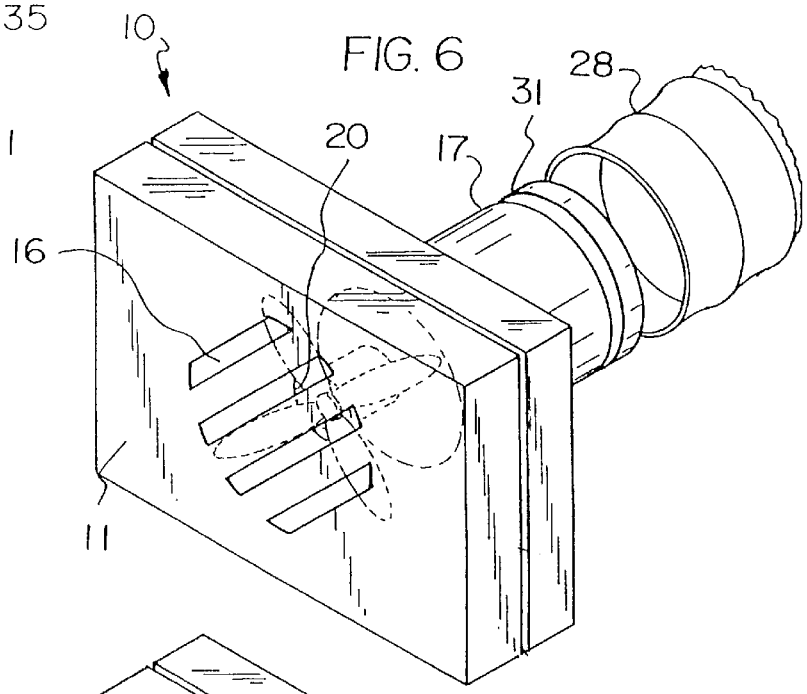
FIG. 6 is a schematic front perspective view of the blower housing.

With reference to FIG. 5, the outer tube has a plurality of spaced apart vent holes 35 into the lumen of the outer tube arranged in a row extending between the upper and lower ends of the outer tube generally parallel to the longitudinal axis of the outer tube, the vent holes of the outer tube facing in an outwardly direction from the wall surface. The vent holes of the outer tube are preferably spaced apart at generally equal intervals in the row. The inner tube has an elongate full vent slot 36 into the lumen of the inner tube extending between the upper and lower ends of the inner tube generally parallel to longitudinal axis of the inner tube.

The inner tube also preferably has a plurality of spaced apart partial vent slots 37,38 arranged in a pair of rows extending between the upper and lower ends of the inner tube adjacent the full vent slot and generally parallel to the longitudinal axis of the inner tube. The partial vent slots 37 of a first of the pair of rows are staggered with the partial vent slots 38 of a second of the pair of rows. Each of the partial vent slots is associated with a vent hole of the outer tube lie in a generally common horizontal plane (or plane perpendicular to the longitudinal axes of the tubes) with the respective partial vent slot.

In use, the inner tube is rotatable in the outer tube into first, second, third and fourth positions. The full vent slot of the inner tube is commonly aligned with the row of vent holes of the outer tube when the inner tube is rotated to the first position to permit air to be blown out of the inner tube through the full vent slot of the inner tube and the row of vent holes of the outer tube so that a user standing next to the vent holes may be dried off with the blowing air.

A first of the rows of the partial vent slots of the inner tube is commonly aligned with the row of vent holes of the outer tube when the inner tube is rotated to the second position to permit air to be blown out of the inner tube through the partial vent slots of the first row and the associated vent holes of the row of vent holes of the outer tube so that a user standing next to the vent holes may be dried off with the blowing air.

A second of the rows of the partial vent slots of the inner tube is commonly aligned with the row of vent holes of the outer tube when the inner tube is rotated to the third position to permit air to be blown out of the inner tube through the partial vent slots of the second row and the associated vent holes of the row of vent holes of the outer tube so that a user standing next to the vent holes may be dried off with the blowing air.

None of the vent slots of the inner tube are commonly aligned with the row of vent holes of the outer tube when the inner tube is rotated to the fourth position so that no air is passed out of the inner tube via the vent holes of the outer tube.

Figure 2A:
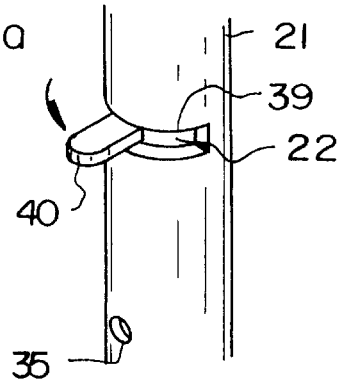
FIG. 2*a* is a schematic enlarged perspective view of the lever and transverse slot of the inner and outer tubes.
Figure 2B:
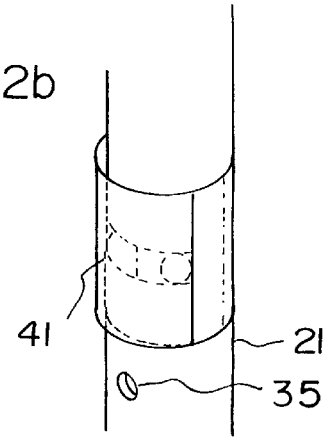
FIG. 2*b* is a schematic enlarged perspective view of the embodiment of the present invention where the lever and slot are covered by a rotatable sleeve.

With reference to FIG. 2*a*, the outer tube has a transverse slot 39 and the inner tube has a lever 40 outwardly extending from the transverse slot to permit rotation of the inner tube in the outer tube with the outer tube. As illustrated in FIG. 2*b*, preferably an annular sleeve 41 is rotatably disposed around the outer tube and is coupled to and substantially covers the lever to prevent water from passing between the tubes and so that the cover is rotatable about the outer tube to rotate the inner tube therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body dryer system, comprising:

a blower housing adapted for mounting to a wall surface;

said blower housing having an inlet and outlet openings;

said blower housing having a heater therein;

said blower housing having a fan therein for drawing air into said blower via said inlet opening and out of said blower housing via said outlet opening;

an elongate outer tube and an elongate inner tube disposed in said outer tube to permit rotation of said inner tube;

said outer and inner tubes each having opposite upper and lower ends, and a longitudinal axis extending between said upper and lower ends of the respective tube;

said upper and lower end of said outer tube being adapted for mounting to the wall surface;

said upper end of said inner tube being in communication with said outlet opening of said blower housing;

said outer tube having a plurality of spaced apart vent holes arranged in a row extending between said upper and lower ends of said outer tube;

said inner tube having an elongate full vent slot extending between said upper and lower ends of said inner tube; and said inner tube having a plurality of spaced apart partial vent slots arranged in a pair of rows extending between said upper and lower ends of said inner tube adjacent said full vent slot.

2. The body dryer system of claim 1, wherein said back face of said blower housing has an outlet tube extending therefrom, said outlet opening being located in said outlet tube.

3. The body dryer system of claim 1, wherein said upper and lower ends of said outer tube each have an extent extending therefrom generally perpendicular to said longitudinal axis of said outer tube, said extents being adapted for mounting to said wall surface such that said outer tube is spaced apart from said wall surface.

4. The body dryer system of claim 1, wherein a flexible hose connects said upper end of said inner tube to said outlet opening of said blower housing.

5. The body dryer system of claim 1, further comprising a switch being electrically connected to said fan and said heater for permitting selective activation of said fan and heater, said switch having a housing adapted for mounting to said wall surface adjacent said blower housing.

6. The body dryer system of claim 5, wherein said switch has a pull cord actuator downwardly depending from said housing of said switch, and wherein said switch has an indicator light source on said housing of said switch.

7. The body dryer system of claim 1, wherein said outer tube has a transverse slot, said inner tube having a lever outwardly extending from said transverse slot to permit rotation of said inner tube in said outer tube with said outer tube.

8. The body dryer system of claim 7, wherein an annular sleeve is rotatably disposed around said outer tube and is coupled to and substantially covers said lever to prevent water from passing between the tubes, said cover being rotatable about said outer tube to rotate said inner tube therein.

9. A body dryer system, comprising:

a vertical wall surface;

a blower housing having front and back faces, said blower housing being mounted to said wall surface;

said blower housing having a pair of mounting holes in said back face of said blower housing;

a pair of mounting fasteners being outwardly extended from said wall surface, each of said mounting fasteners being inserted into an associated mounting hole of said blower housing to mount said blower housing to said wall surface;

said front face of said blower housing having an inlet opening into said blower housing;

said back face of said blower housing having an outlet tube extending therefrom into said wall surface, said outlet tube having an outlet opening into said blower housing;

said blower housing having a heater therein for heating air in said blower housing;

said blower housing having a fan therein for drawing air into said blower via said inlet opening, past said heater, and out of said blower housing via said outlet opening such that air passing through said blower housing is heated by said heater;

an elongate outer tube and an elongate inner tube disposed in said outer tube to permit rotation of said inner tube;

said outer and inner tubes each having opposite upper and lower ends, and a longitudinal axis extending between said upper and lower ends of the respective tube;

said upper end of said inner tube being positioned adjacent said upper end of said outer tube, said lower end of said inner tube being positioned adjacent said lower end of said lower tube;

said longitudinal axes of said outer and inner tubes being generally coaxial with one another, said inner tube being rotatable in said outer tube about an axis of rotation coaxial with said longitudinal axes of said outer and inner tubes;

said upper and lower end of said outer tube being mounted to said wall surface, said longitudinal axis of said outer and inner tubes being extended generally vertically and generally parallel to said wall surface;

wherein said upper and lower ends of said outer tube each have an extent extending therefrom generally perpendicular to said longitudinal axis of said outer tube, said extents being mounted to said wall surface such that said outer tube is spaced apart from said wall surface;

said extents each having an annular mounting flange and an annular flange cover disposed therearound;

said mounting flanges of said extents each having a plurality of mounting holes therethrough, each of said mounting holes of each mounting flange having a fastener extended therethrough and into said wall surface to mount said mounting flanges to said wall surface;

said flange covers each covering the associated mounting flange on said wall surface;

said extent of said upper end of said outer tube being inserted into said wall surface;

said upper end of said inner tube being in communication with said outlet opening of said blower housing via said extent of said outer tube;

wherein a flexible hose extending through said wall surface connects said upper end of said inner tube to said outlet opening of said blower housing;

said hose having a pair of opposite open ends, said outlet tube of said blower housing being inserted into one of said ends of said hose to connect said outlet opening to said hose, said extent of said upper end of said outer tube being inserted into the other of said ends of said hose to connect said outlet opening to said hose;

a switch being electrically connected to said fan and said heater for permitting selective activation of said fan and heater;

said switch having a housing being mounted to said wall surface adjacent said blower housing;

said switch having a pull cord actuator downwardly depending from said housing of said switch;

said switch having an indicator light source on said housing of said switch;

said outer tube having a plurality of spaced apart vent holes arranged in a row extending between said upper and lower ends of said outer tube generally parallel to said longitudinal axis of said outer tube, said vent holes of said outer tube facing in an outwardly direction from said wall surface;

said vent holes of said outer tube being spaced apart at generally equal intervals in said row;

said inner tube having an elongate full vent slot extending between said upper and lower ends of said inner tube generally parallel to longitudinal axis of said inner tube;

said inner tube having a plurality of spaced apart partial vent slots arranged in a pair of rows extending between said upper and lower ends of said inner tube adjacent said full vent slot and generally parallel to said longitudinal axis of said inner tube;

said partial vent slots of a first of said pair of rows being staggered with said partial vent slots of a second of said pair of rows; and each of said partial vent slots being associated with a vent hole of said outer tube lying in a generally common horizontal plane with the respective partial vent slot.

* * * * *